US009907145B2

(12) United States Patent
Saijo

(10) Patent No.: US 9,907,145 B2
(45) Date of Patent: Feb. 27, 2018

(54) REPRODUCTION DEVICE AND REPRODUCTION METHOD

(71) Applicant: SONY CORPORATION, Tokyo (JP)

(72) Inventor: Nobuhiro Saijo, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/608,312

(22) Filed: May 30, 2017

(65) Prior Publication Data

US 2017/0265281 A1 Sep. 14, 2017

Related U.S. Application Data

(63) Continuation of application No. 15/035,803, filed as application No. PCT/JP2014/005416 on Oct. 27, 2014, now Pat. No. 9,674,928.

(30) Foreign Application Priority Data

Dec. 17, 2013 (JP) ..... 2013-260061

(51) Int. Cl.
*H05B 37/02* (2006.01)
*F21V 33/00* (2006.01)
(Continued)

(52) U.S. Cl.
CPC ..... *H05B 37/0236* (2013.01); *F21V 33/0056* (2013.01); *H04R 1/028* (2013.01); *H04R 1/26* (2013.01); *H04R 3/14* (2013.01); *H04R 5/04* (2013.01); *H05B 33/0815* (2013.01); *H05B 33/0854* (2013.01); *H05B 33/0872* (2013.01); *H05B 37/029* (2013.01); *H05B 37/0281* (2013.01); *F21Y 2103/33* (2016.08); *F21Y 2115/10* (2016.08); *H04R 3/12* (2013.01); *H04R 2430/01* (2013.01)

(58) Field of Classification Search
CPC ..... H01L 2924/00; H01L 2924/07802; H01L 2924/12041; H01L 2924/12044; H01L 24/75; H01L 33/52; H01L 33/56; H01L 2251/5315; H01L 2251/5323; H01L 2251/564; H01L 27/12; H01L 27/1292; H01L 27/3244
See application file for complete search history.

(56) References Cited

FOREIGN PATENT DOCUMENTS

JP 06-070386 A 3/1994
JP 2000-267657 A 9/2000
(Continued)

OTHER PUBLICATIONS

Notice of Allowance and Fees Due (PTOL-85) for U.S. Appl. No. 15/035,803, dated Feb. 10, 2017, 7 pages.

*Primary Examiner* — Monica C King
(74) *Attorney, Agent, or Firm* — Chip Law Group

(57) ABSTRACT

A reproduction device includes a plurality of speakers each of which reproduces a sound corresponding to an audio signal, a plurality of light emission elements, a detection unit that analyzes the audio signal, and outputs a timing signal corresponding to an analysis result, a light emission control unit that allows the light emission elements to emit light in a first light emission mode or a second light emission mode, and a switching control unit that provides a switchable period for switching one of the light emission modes to the other of the light emission modes, and determines whether to switch the current light emission mode in response to a trigger of the timing signal input in the switchable period.

11 Claims, 11 Drawing Sheets

(51) Int. Cl.

| | |
|---|---|
| ***H04R 1/02*** | (2006.01) |
| ***H04R 3/14*** | (2006.01) |
| ***H05B 33/08*** | (2006.01) |
| ***H04R 1/26*** | (2006.01) |
| ***H04R 5/04*** | (2006.01) |
| *H04R 3/12* | (2006.01) |
| *F21Y 115/10* | (2016.01) |
| *F21Y 103/33* | (2016.01) |

(56) References Cited

FOREIGN PATENT DOCUMENTS

| | | | |
|---|---|---|---|
| JP | 2001-067053 | A | 3/2001 |
| JP | 2004-282219 | A | 10/2004 |
| JP | 2010-192155 | A | 9/2010 |

REPRODUCTION DEVICE AND REPRODUCTION METHOD

CROSS-REFERENCE TO RELATED APPLICATIONS

The present application is a continuation application of U.S. patent application Ser. No. 15/035,803, filed May 11, 2016, which is a national stage entry of PCT application PCT/JP2014/005416 filed Oct. 27, 2014 and which claims the benefit of Japanese Priority Patent Application 2013-260061 filed Dec. 17, 2013, the entire contents of which are incorporated herein by reference.

TECHNICAL FIELD

The present disclosure relates to a reproduction device and a reproduction method.

BACKGROUND ART

Preference of a person in music tends to differ from region to region. For example, Japanese people reproduce music by using a reproduction device equipped with a dock for receiving a portable music player. In general, compact and unified design is preferred by Japanese people.

On the other hand, people in South American countries tend to prefer a large-sized reproduction device including a decorative light source. People using this type of reproduction device reproduce music with a loud volume at a home party or the like. Light emission from the light source in accordance with reproduction of music gives the people a sense of a live concert, or an illusion of being present in a nightclub, and thus increases attraction of the reproduction device. However, simple lighting from the light source in accordance with music may produce only a sense of monotony for the people when one or a plurality of tunes are continuously reproduced. For overcoming this drawback, there has been proposed a technology which analyzes sections of music and musical characteristics for each section, and allows an illumination to emit light in patterns different for each section, as described in Patent Document 1 identified below.

CITATION LIST

Patent Document

Patent Document 1: Japanese Patent Application Laid-Open No. 2010-192155

SUMMARY OF THE INVENTION

Problems to be Solved by the Invention

However, there is arising such a problem from Patent Document 1, that a complicated analysis technology is required for accurate analysis of sections of music and musical characteristics for each section.

An object of the present disclosure developed under these circumstances is to provide a reproduction device and a reproduction method capable of producing a large atmospheric change at the time of reproduction of music without the necessity of use of a complicated analysis technology for music data.

Solutions to Problems

For solving the aforementioned problems, the present disclosure is directed, for example, to a reproduction device including:

a plurality of speakers each of which reproduces a sound corresponding to an audio signal;

a plurality of light emission elements;

a detection unit that analyzes the audio signal, and outputs a timing signal corresponding to an analysis result;

a light emission control unit that allows the light emission elements to emit light in a first light emission mode or a second light emission mode; and a switching control unit that provides a switchable period for switching one of the light emission modes to the other of the light emission modes, and determines whether to switch the current light emission mode in response to a trigger of the timing signal input in the switchable period.

The present disclosure is directed, for example, to a reproduction method of a reproduction device, wherein a detection unit analyzes an audio signal supplied to a speaker and outputs a timing signal corresponding to an analysis result, a light emission control unit allows light emission elements to emit light in a first light emission mode or a second light emission mode, and a switching control unit provides a switchable period for switching one of the light emission modes to the other of the light emission modes, and determines whether to switch the current light emission mode in response to a trigger of the timing signal input in the switchable period.

Effects of the Invention

According to at least one embodiment, a large atmospheric change is produced at the time of reproduction of music without the necessity of use of a complicated analysis technology for music data. Effects to be provided are not limited to the above-mentioned effect, but may be any effects described in the present disclosure. No limitation is imposed on interpretation of the contents of the present disclosure by the effects described below only by way of example.

Figure 7:
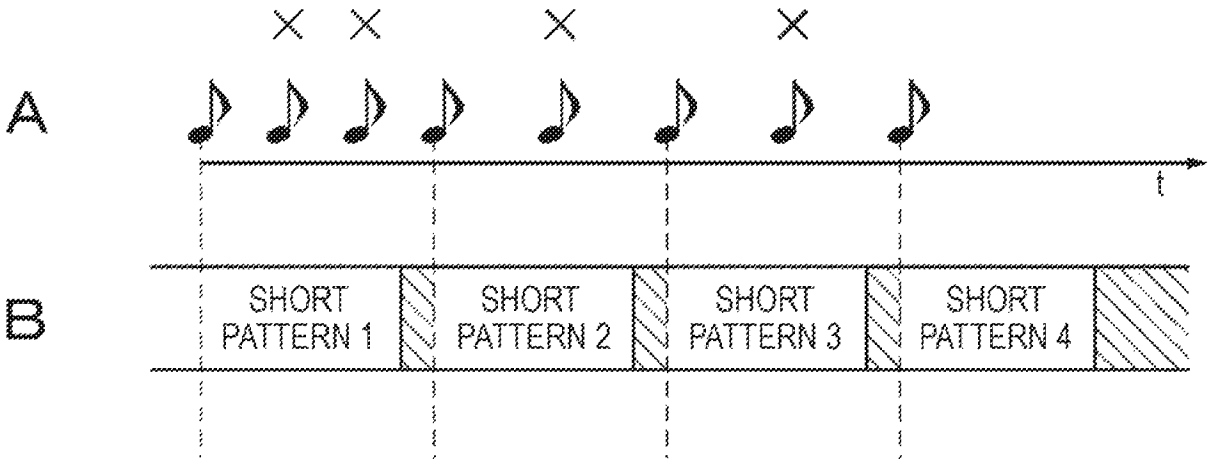

Parts A and B in FIG. 7 are views illustrating an example of a short pattern to be presented.

Figure 8:
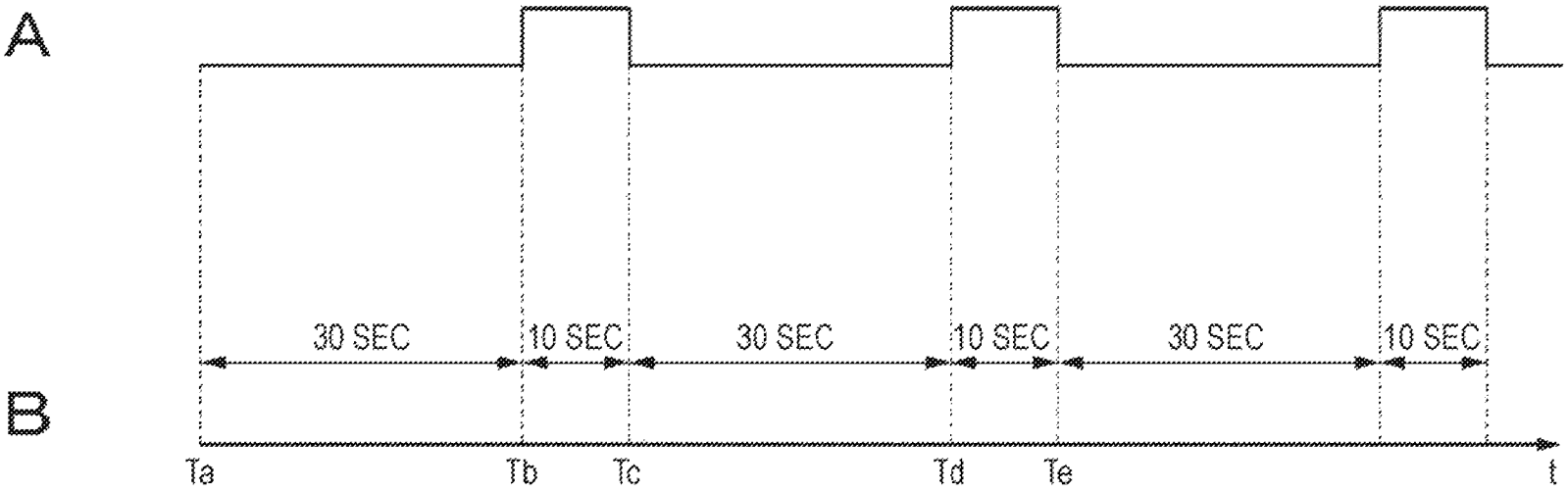

A part A in FIG. 8 illustrates an example of a first switchable period, while a part B in FIG. 8 shows a time axis.

Figure 9:
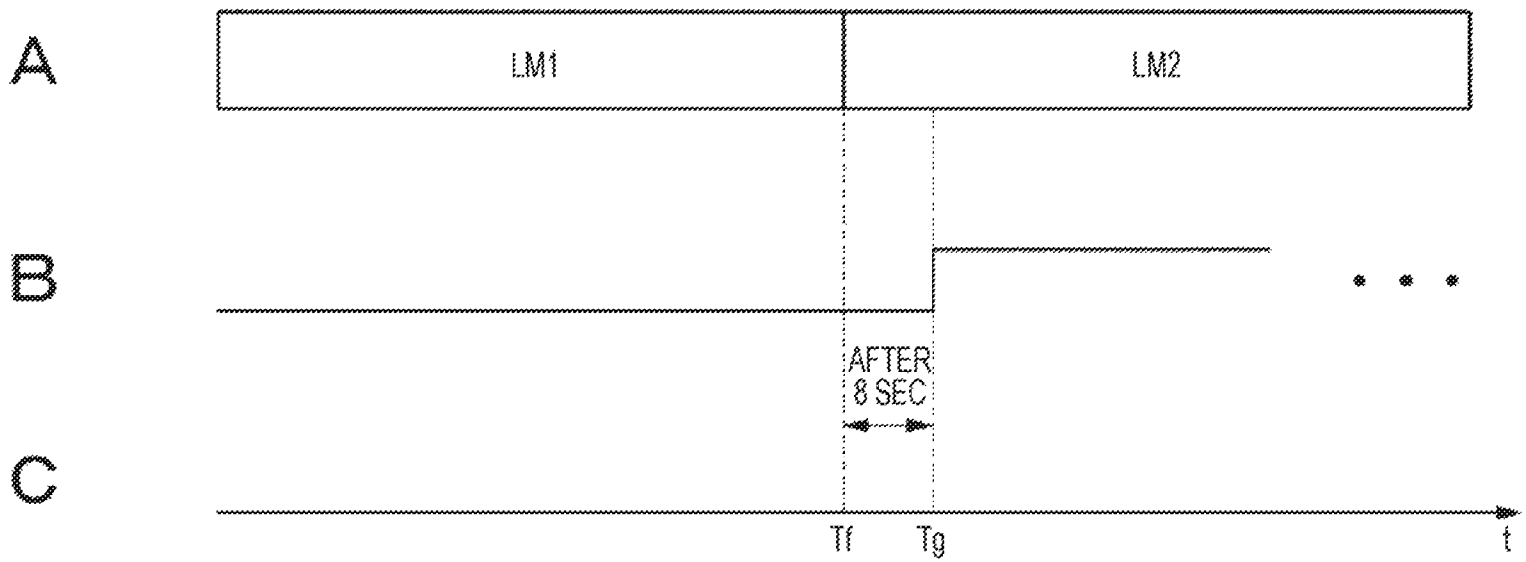

A part A in FIG. 9 illustrates a light emission mode, a part B in FIG. 9 illustrates a second switchable period, and a part C in FIG. 9 shows a time axis.

Figure 10:
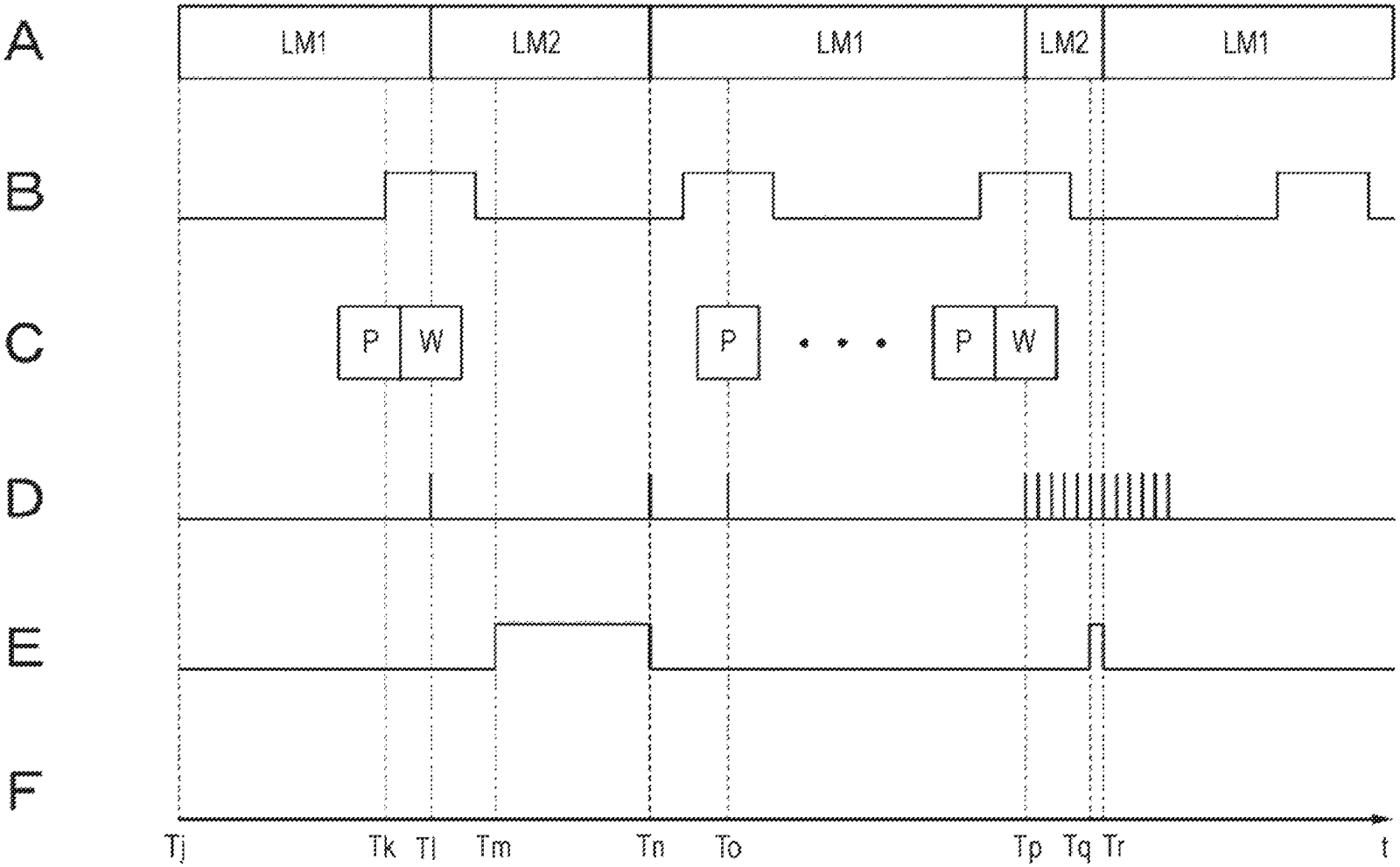

A part A in FIG. 10 illustrates a light emission mode, a part B in FIG. 10 illustrates a first switchable period, a part C in FIG. 10 illustrates states in a first light emission mode, a part D in FIG. 10 indicates the presence or absence of input of a timing signal, a part E in FIG. 10 illustrates the second switchable period, and a part F in FIG. 10 shows a time axis.

Figure 11:
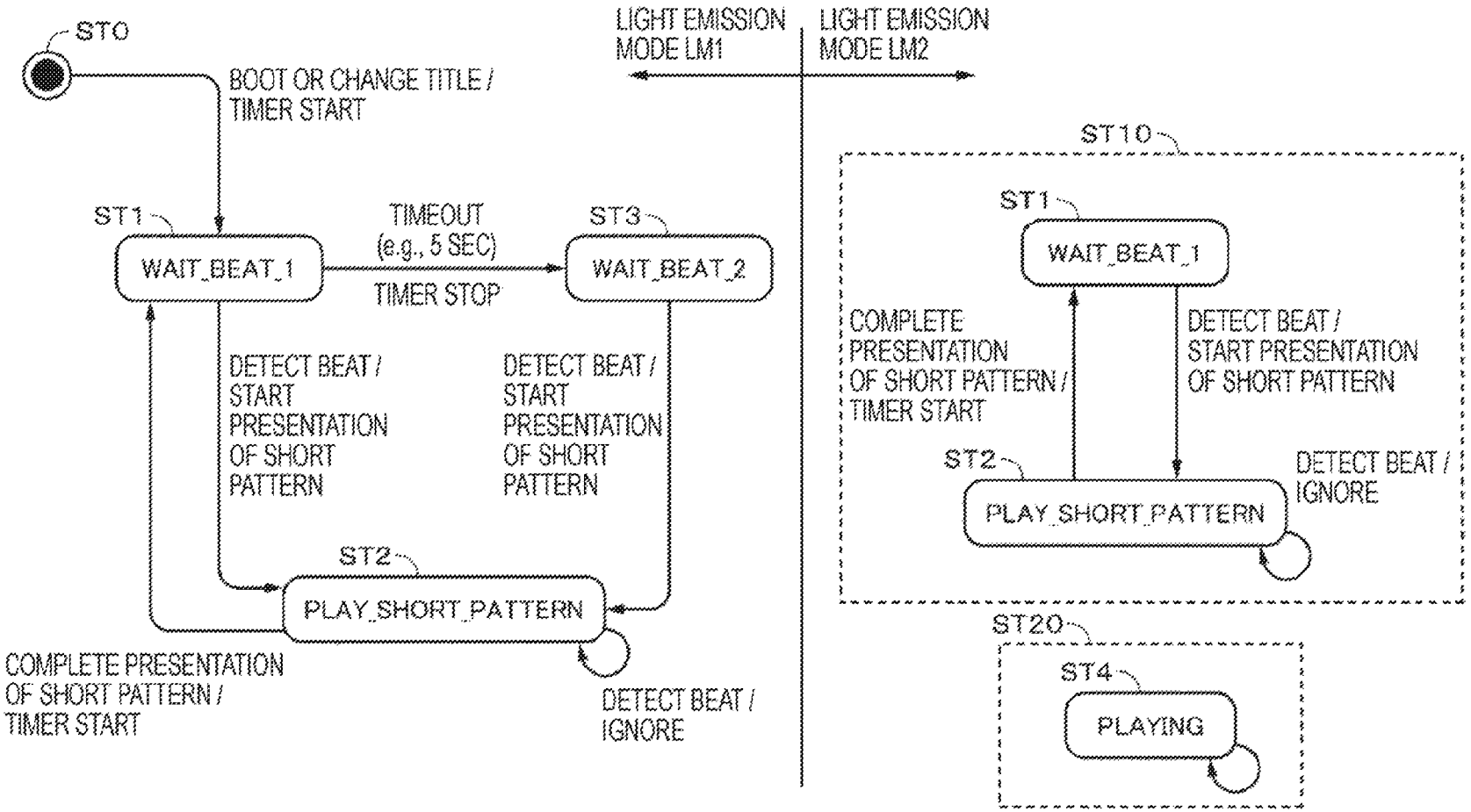

FIG. 11 is a view illustrating a transition of states in respective light emission modes according to a second embodiment.

Figure 12:
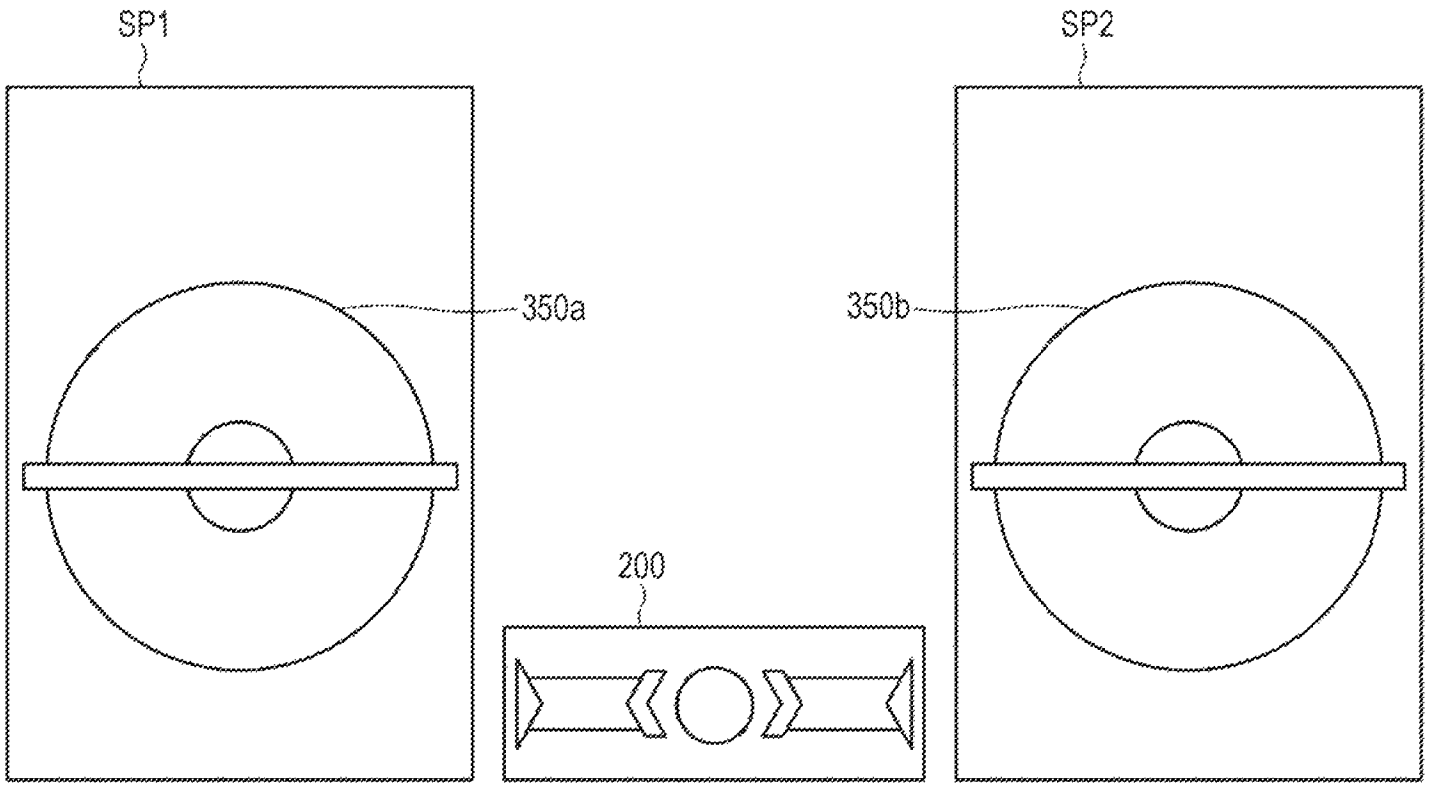

FIG. 12 is a view illustrating a modified example.

MODE FOR CARRYING OUT THE INVENTION

A plurality of embodiments according to the present disclosure are hereinafter described with reference to the drawings. The respective embodiments are described in the following order.

<1. First Embodiment>
<2. Second Embodiment>
<3. Modified Examples>

The embodiments and the like described herein are presented only by way of preferred specific example of the present disclosure. The contents of the present disclosure are not limited to the embodiments and the like described herein.

1. First Embodiment

[Configuration Example of Reproduction Device]

Figure 1:
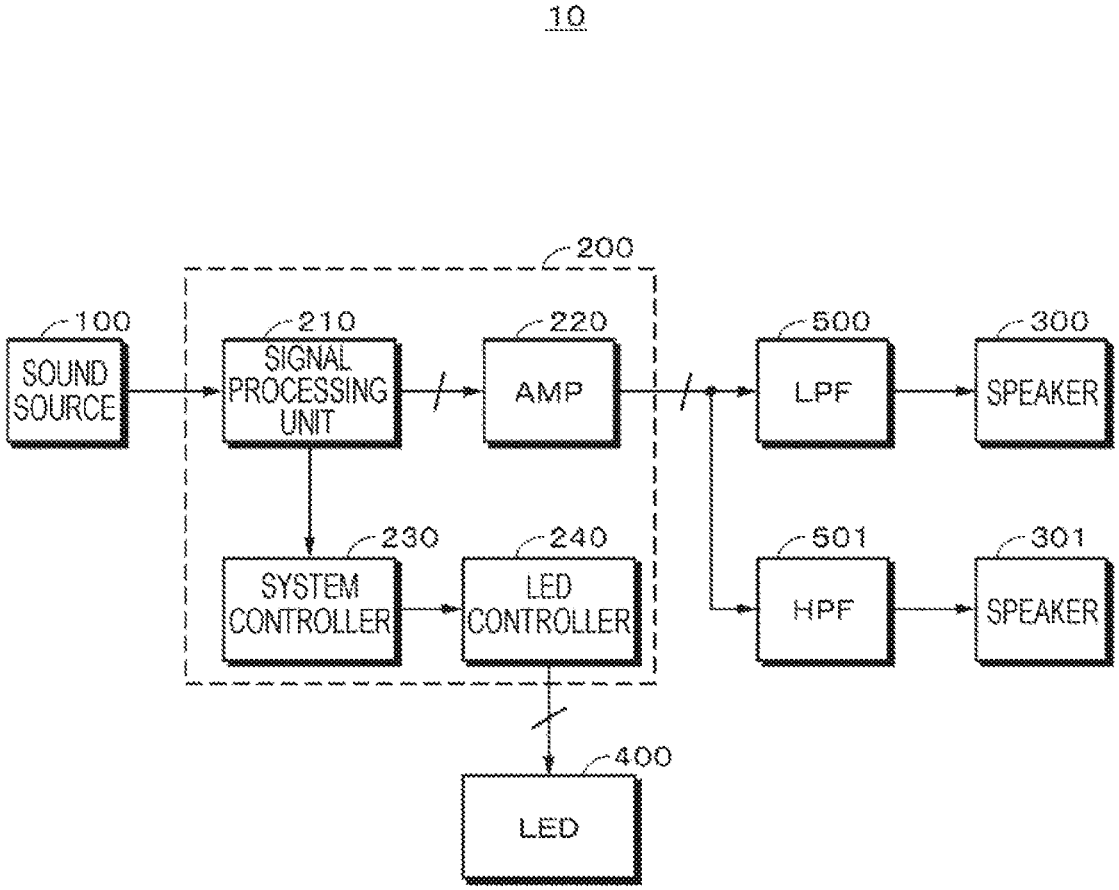
FIG. 1 is a block diagram illustrating a configuration example of a reproduction device.

FIG. 1 illustrates a configuration example of a reproduction device according to a first embodiment of the present disclosure. The reproduction device according to the first embodiment is a stationary audio reproduction device for reproducing sounds, for example. Sounds may be voices of a person, music or others allowed to be heard by the ears of a person. An audio reproduction device 10 includes a sound source 100, a control unit 200, a speaker 300, a speaker 301, a Light Emitting Diode (LED) 400, a Low Pass Filter (LPF) 500, and a High Pass Filter (HPF) 501.

The sound source 100 includes digital audio signals stored in a Universal Serial Bus (USB) memory, audio signals reproduced from a disk-shaped recording medium such as a Compact Disk (CD), and broadcasting audio signals received by a tuner, for example.

The control unit 200 includes a signal processing unit 210, an amplifier (AMP) 220, a system controller 230, and an LED controller 240.

The signal processing unit 210 is constituted by a Digital Signal Processor (DSP), for example. The signal processing unit 210 executes various types of signal processing, such as decoding for compressed audio data. The signal processing unit 210 performs a music analysis function which corresponds to processing according to the embodiment of the present disclosure. The music analysis function is a function for detecting a beat of a digital audio signal received from the sound source 100, and outputting a timing signal synchronous with the timing of the detected beat. For example, frequencies of audio data are analyzed by utilizing Fourier analysis to extract low frequency components. A beat is detected from gains of the extracted low frequency components. The method for detecting a beat may be other known methods. A typical beat is constituted by a bass beat. However, a beat in the context of the present disclosure has a meaning similar to the meaning of a rhythm or musical time. The timing signal generated by the signal processing unit 210 is supplied to the system controller 230 as a trigger signal.

The system controller 230 performs a plurality of functions under programs stored in a not-shown ROM, for example, and executed by the system controller 230, and generates control signals for controlling respective units of the audio reproduction device 10. Moreover, various types of operation signals input through a not-shown user interface (key switch, touch panel or the like) are supplied to the system controller 230.

The system controller 230 has a timing function such as a timer, and provides a light emission mode switchable period of the LED 400 (hereinafter referred to as switchable period as appropriate) by using this function. The system controller 230 determines whether to switch a light emission mode of the LED 400 to other modes in response to a trigger of a timing signal input from the signal processing unit 210 during the switchable period. Accordingly, the system controller 230 functions as an example of a switching control unit.

One or a plurality of control states are specified in each of the light emission modes. A light emission pattern presented to a user is determined for each of the control states. Specific light emission patterns are stored in the ROM connected with the system controller 230, for example. The light emission patterns may be stored in a rewritable memory for update of the light emission patterns. The light emission patterns defined as a concept herein include a pattern for allowing no emission from all or a part of LEDs.

The LED controller 240 generates a light emission control signal for controlling timing of light emission or no light emission from the LED 400, and brightness of light at the time of emission under the control by the system controller 230. The light emission control signal output from the LED controller 240 is supplied to the LED 400 containing a plurality of LEDs. Luminance of the LED 400 varies in accordance with the light emission control signal.

The LEDs contained in the LED 400 are not limited to monochromatic LEDs, but may be multicolor LEDs emitting lights in a plurality of colors (such as lights in three primary colors (red, green, and blue)). In case of a structure capable of emitting multicolor lights, the color of light may be switched to the other colors.

The amplifier 220 amplifies analog audio signals of a plurality of channels output from the signal processing unit 210. The analog audio signals output from the amplifier 220 are branched and supplied to each of the LPF 500 and the HPF 501.

The LPF 500 is connected to the speaker 300. The LPF 500 is a filter which regulates the band of the analog audio signals received from the amplifier 220 to a range of predetermined frequencies or lower. The analog audio signals output from the LPF 500 are supplied to the speaker 300 to reproduce low range sounds through the speaker 300. The speaker 300 is a general term of a speaker unit for reproducing low range sounds.

The HPF 501 is connected to the speaker 301. The HPF 501 is a filter which regulates the band of the analog audio signals received from the amplifier 220 to a range of predetermined frequencies or higher. The analog audio signals output from the HPF 501 are supplied to the speaker 301 to reproduce middle and high range sounds through the speaker 301. The speaker 301 is a general term of a speaker unit for reproducing middle and high range sounds.

[Example of External Appearance of Audio Reproduction Device]

Figure 2:
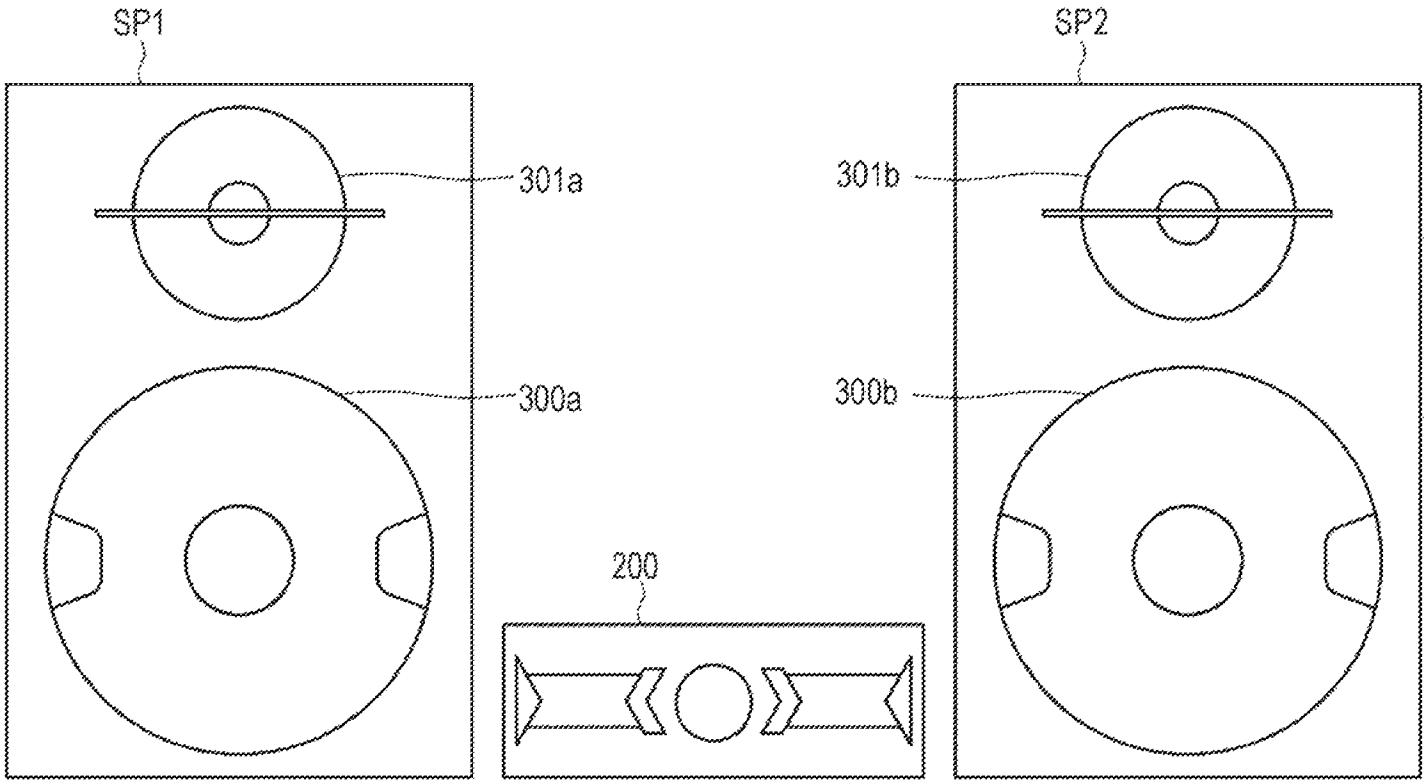
FIG. 2 is a view illustrating an example of an external appearance of the reproduction device.

The audio reproduction device 10 has an external appearance illustrated in FIG. 2, for example. Two speakers SP1 and SP2 are arranged on the left side and the right side, respectively, while the control unit 200 is disposed substantially at the center of the arrangement of the speakers, for example.

The speaker SP1 reproduces sounds of a left (L) channel. A speaker unit 300*a* for low range reproduction and a speaker unit 301*a* for middle and high range reproduction of the speaker SP1 are attached to a common enclosure. The diameter of the speaker unit 300*a* is larger than the diameter of the speaker unit 301*a*.

The speaker SP2 reproduces sounds of a right (R) channel. A speaker unit 300*b* for low range reproduction and a speaker unit 301*b* for middle and high range reproduction of the speaker SP2 are attached to a common enclosure. The diameter of the speaker unit 300*b* is larger than the diameter of the speaker unit 301*b*.

Figure 3:
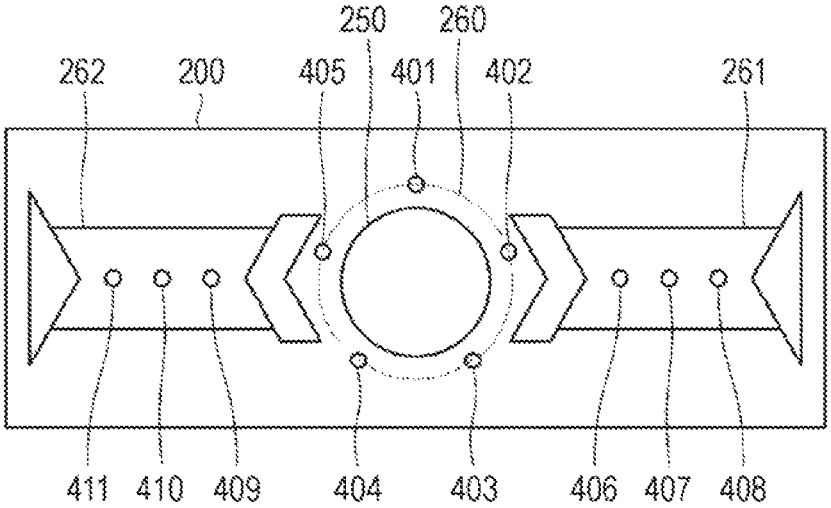
FIG. 3 is a view illustrating an example of an external appearance of a control unit.

As illustrated in FIG. 3, a volume control 250 is provided in a central portion of a front panel of the control unit 200. A ring-shaped light emission unit 260 is provided along the outer circumference of the volume control 250. The ring-shaped light emission unit 260 is constituted by a plurality of LEDs (such as five LEDs 401, 402, 403, 404, and 405), and a light guide body. Band-shaped light emission units 261 and 262 are further provided on the left and right areas of the volume control 250, respectively. The light emission unit 261 is constituted by a plurality of linearly arranged LEDs (such as three LEDs 406, 407, and 408), and a light guide body. The light emission unit 262 is constituted by a plurality of linearly arranged LEDs (such as three LEDs 409, 410, and 411), and a light guide body.

A light emission mode of the LEDs included in the control unit 200 may be arbitrarily set. For example, the five LEDs constituting the ring-shaped light emission unit 260 may emit light either sequentially in a rotational direction, or at a time. Similarly, the LEDs constituting the light emission unit 261 and the light emission unit 262 may emit light either sequentially in one direction, or at a time.

There may be further provided not-shown power source switch, bass boost switch, USB memory attachment portion and the like on the front surface or back surface of the control unit 200.

Figure 4:
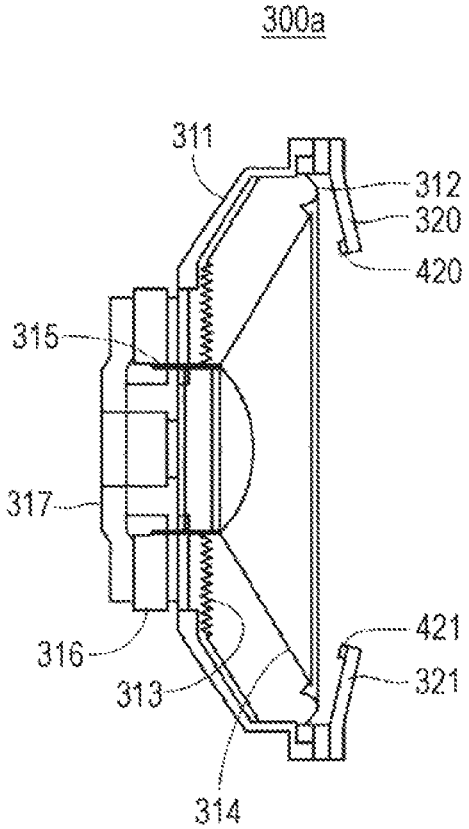
FIG. 4 is a view illustrating a configuration example of a speaker unit for reproducing low range sounds.

Each of the speakers SP1 and SP2 is constituted by an outer magnetic type dynamic speaker. The speaker unit 300*a* of the speaker SP1 has a configuration illustrated in FIG. 4. Described hereinbelow is a configuration example of the speaker unit 300*a*, which is also applicable to the configuration of the speaker unit 300*b*. As illustrated in FIG. 4, a diaphragm (cone paper) 314 is attached to a frame 311 via an edge 312 and a damper 313. A voice coil 315 is provided at a base portion of the diaphragm 314. The voice coil 315 is positioned at a magnetic gap formed by a ring magnet 316 and a yoke 317. The voice coil 315 shifts in response to an audio signal, and vibrates the diaphragm 314 to reproduce music.

Two arms 320 and 321 project from an outer circumferential portion of the speaker unit 300*a* toward the front of the speaker unit 300*a*. An LED 420 is attached to a portion in the vicinity of the tip of the arm 320, while an LED 421 is attached to a portion in the vicinity of the tip of the arm 321. Light emitted from each of the LEDs 420 and 421 illuminates a portion in the vicinity of the center of the diaphragm 314 from the front, for example. The diaphragm 314 made of material mixed with mica or other high reflection materials has high reflectance. Accordingly, light emitted from the LED 420 and the like is reflected on the diaphragm 314 toward the front to display the speaker unit 300*a* as a bright component. As described above, the LED 420 and the like may be constituted by a monochromatic light source which emits light in one of colors of white, blue, red, green and others, or may be constituted by a multicolor light source capable of emitting lights in a plurality of these colors selectively or at a time. Alternatively, the LED 420 and the like may be constituted by light emission elements other than LEDs.

Figure 5:
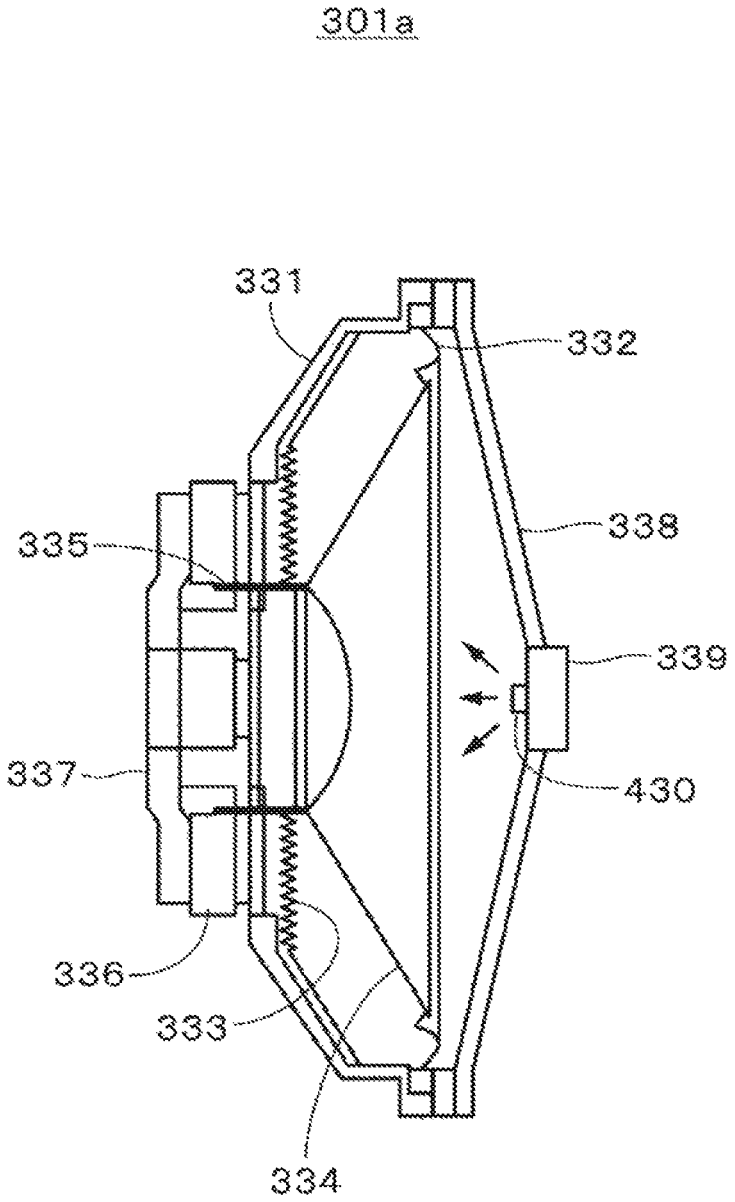
FIG. 5 is a view illustrating a configuration example of a speaker unit for reproducing middle and high range sounds.

The speaker unit 301*a* of the speaker SP1 has a configuration illustrated in FIG. 5. Described hereinbelow is a configuration example of the speaker unit 301*a*, which is also applicable to the configuration of the speaker unit 301*b*. As illustrated in FIG. 5, a diaphragm (cone paper) 334 is attached to a frame 331 via an edge 332 and a damper 333. A voice coil 335 is provided at a base portion of the diaphragm 334. The voice coil 335 is positioned at a magnetic gap formed by a ring magnet 336 and a yoke 337. The voice coil 335 shifts in response to an audio signal, and vibrates the diaphragm 334 to reproduce music.

A front frame 338 constituted by an arm crosses the front surface of the speaker unit 301*a*, while a plate 339 lies substantially at the center of the front frame 338. An LED 430 is attached to the rear surface of the plate 339. Light emitted from the LED 430 is applied to the diaphragm 334 in a direction from the front. The diaphragm 334 made of material mixed with mica or other high reflection materials has high reflectance. Accordingly, light emitted from the LED 430 is reflected on the diaphragm 334 toward the front to display the speaker unit 301*a* as a bright component. As described above, the LED 430 may be constituted by a monochromatic light source which emits light in one of colors of white, blue, red, green and others, or may be constituted by a multicolor light source capable of emitting lights in a plurality of these colors selectively or at a time. Alternatively, the LED 430 may be constituted by a light emission element other than an LED.

[LED Light Emission Mode]

Figure 6:
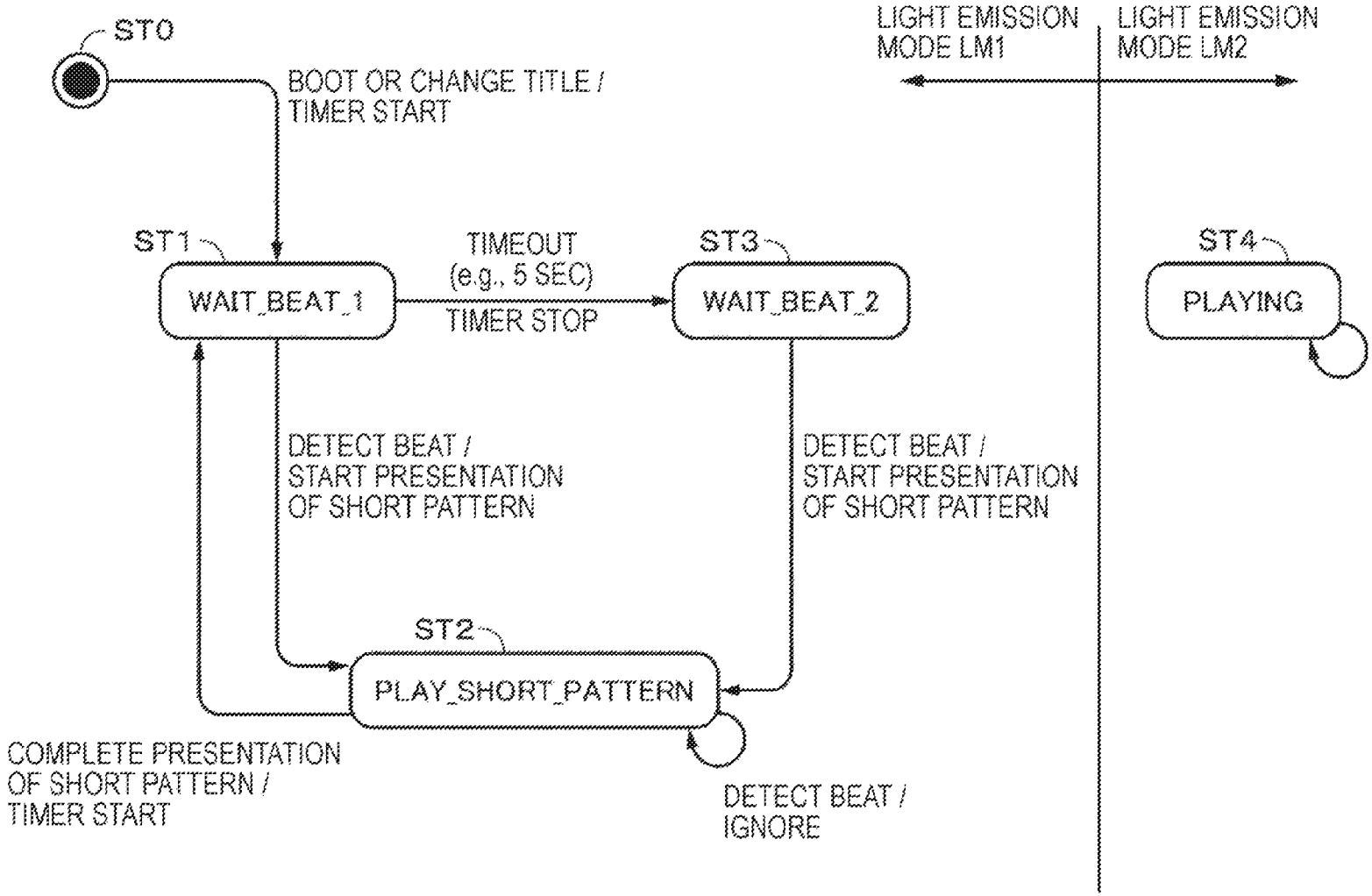
FIG. 6 is a view illustrating a transition of states in respective light emission modes according to a first embodiment.

The light emission mode of the LED 400 is hereinafter described with reference to FIG. 6. According to the first embodiment, the light emission mode is switchable between a first light emission mode (hereinafter referred to as light emission mode LM1 as appropriate), and a second light emission mode (hereinafter referred to as light emission mode LM2 as appropriate) under control by the system controller 230, for example.

The light emission mode LM1 is initially discussed. Shown below are the details of respective control states (hereinafter abbreviated as states as appropriate) in the light emission mode LM1 illustrated in FIG. 6.

State ST0: start state A state transition starts from the state ST0.

State ST1: beat detection waiting state In this state, the system controller 230 is waiting for input of a timing signal. The LED 400 does not emit light, or indicates a monochromatic color in this state. Accordingly, no motion of light is produced. No animation is displayed.

State ST2: state for reproducing short pattern defined beforehand in synchronization with input of timing signal A short pattern is presented in this state.

State ST3: beat detection waiting state Light motion is produced in the state ST3 unlike the state ST1. For example, an animation asynchronous with a beat of music is presented.

Each length of beat intervals varies depending on types of music, wherefore there may be produced a relatively long period of no detection of a beat. Moreover, no beat is detectable in a period of title change between respective tunes. Furthermore, gains of bass components of some types of music may be so low that no beat is detectable in a relatively long period. In these cases, no decorative display is presented to the user for a long period without emission of light from the LED 400. As a result, excitement or elation produced by decorative display may decrease or disappear. This problem becomes more serious when the audio reproduction device is used in a dark room.

In consideration of this point, the LED controller 240 is configured to generate a second light emission control signal for controlling the light emission pattern of the LED 400 when the period of no detection of a beat exceeds a setting time, apart from a first light emission control signal for controlling the light emission pattern of the LED 400. The first light emission control signal is a signal constituted by a plurality of continuous signals for specifying the light emission pattern of the LED 400 (referred to as short pattern as appropriate), which pattern continues for a predetermined period, such as 300 [msec], from input of a timing signal. In other words, the short pattern is a light emission pattern defined beforehand.

The second light emission control signal is a signal for specifying the light emission pattern of the LED 400 (referred to as animation as appropriate) in synchronization with a timing signal generated from a clock signal of the system, for example. A plurality of types of short patterns and one animation are stored in the memory beforehand. The types of short patterns and the generation order of the plurality of short patterns are determined such that attractive display can be realized along with changes of the short patterns in synchronization with the beat of reproduced music. For example, the first light emission control signal is generated and stored such that display can be realized in a manner matched with reproduction of various categories of music, such as rock, Latin, reggae, and fusion. Alternatively, the first and/or second light emission control signals may be generated by the user in accordance with preferences of the user.

An example of specific control operation performed in the light emission mode LM1 is hereinafter described.

When a power supply is turned on (booted) or when a title is changed in the state ST0, the control shifts to the state ST1 with a start of a timer. In the state ST1, none of the LEDs emits light, or all of the LEDs emit monochromatic light until a beat is detected. In this condition, no animation is displayed.

When a beat is detected within a predetermined period (such as 5 [sec]) from the start of the timer in the state ST1, the control shifts to the state ST2 to start presentation of a short pattern using all the LEDs. After completion of presentation of one short pattern, the control returns to the state ST1 with a start of the timer. Even when a new beat is detected during presentation of a certain short pattern in the state ST2, this beat is ignored.

However, when a period corresponding to detection of no beat exceeds a predetermined period in the state ST1, the control shifts to the state ST3 with a stop of the timer. The state ST3 is a beat detection waiting state, in which state an animation asynchronous with the beat of music is presented. The pattern presented in this animation is such a pattern that all of the LEDs are gradually turned on and gradually turned off. When a beat is detected during the state ST3, the control shifts to the state ST2 depending on cases.

In the state ST2, a short pattern is presented as illustrated in FIG. 7. A part A in FIG. 7 shows beats to be detected. Respective marks of musical notes in the figure schematically indicate beats. However, a timing signal generated in signal processing is constituted by a pulse signal indicating a reference of timing. A part B in FIG. 7 shows short patterns to be presented. A short pattern 1 is presented in synchronization with a beat, and a short pattern 2 is presented in synchronization with a subsequent beat. Each display period of the short pattern 1, short pattern 2 and others is set to a substantially equivalent value, such as 300 [msec]. The period from an end of a short pattern to a start of the subsequent beat is determined as a period of no light emission or monochromatic light emission as indicated by diagonal lines. The timer starts with a start of each short pattern. When no beat is detected for 5 [sec] or more, for example, the control shifts to the state ST3 based on determination of timeout.

Beats detected during presentation of each short pattern are ignored as indicated by "X". These beats are ignored to avoid a loss of effect of display caused by switching of short patterns at excessively short intervals. It is preferable that the foregoing period of short patterns is determined based on general characteristics of music to be reproduced. The period of each short pattern in this embodiment is determined in consideration of the fact that beats generated in a cycle shorter than 300 [msec] are relatively rare.

At least either the state ST1 or the state ST3 corresponds to a first control state. The state ST2 corresponds to a second control state. Accordingly, the light emission mode LM1 is a mode capable of switching between at least the first control state and the second control state.

Returning to FIG. 6, the light emission mode LM2 is hereinafter described. In the light emission mode LM2, the state ST4 is defined to present a predetermined light emission pattern in the state ST4. More specifically, the LED controller 240 generates a light emission control signal for allowing the LED 400 to emit light in a predetermined light emission pattern in response to an instruction of light emission issued from the system controller 230 based on the light emission mode LM2. The LED controller 240 supplies the generated light emission control signal to the LED 400.

The light emission pattern presented in the state ST4 is a pattern asynchronous with (independent from) input of a timing signal. For example, the light emission pattern in the state ST4 is a pattern for blinking the LED 400 at a high speed. For example, the LED 400 blinks in a cycle of approximately 100 [msec] (approximately 10 Hz in frequency). In the light emission mode LM2, the LED 400 blinks at a high speed until the light emission mode LM2 is switched to the light emission mode LM1. The high-speed blinking of the LED 400 gives higher elation to the user than the light emission pattern in the light emission mode LM1. In the state ST4, the LED 400 may change the blinking speed during light emission.

[Switchable Period]

A switchable period provided by the system controller 230 is hereinafter described. The system controller 230 provides a first switchable period for switching the light emission mode LM1 to the light emission mode LM2, and a second switchable period for switching the light emission mode LM2 to the light emission mode LM1, for example.

The first switchable period is cyclically provided. A part A in FIG. 8 illustrates an example of the first switchable period, while a part B in FIG. 8 shows a time axis. As illustrated in FIG. 8, the first switchable period continues for 10 seconds for every 30 seconds, for example. The first switchable period is provided at a time Tb corresponding to a time after 30 seconds from a count start time Ta of the timer. The first switchable period continues for 10 seconds (between Tb and Tc), and ends at the time Tc corresponding to a time after 10 seconds. The first switchable period is again provided at a time Td corresponding to a time after 30 seconds from the time Tc. The first switchable period continues for 10 seconds (between Td and Te), and ends at the time Te corresponding to a time after 10 seconds. The first switchable period is cyclically provided in the similar manner for the subsequent periods.

The second switchable period is provided after an elapse of a predetermined time from switching from the light emission mode LM1 to the light emission mode LM2. A part A in FIG. 9 illustrates light emission modes. In the figure, "LM1" indicates the light emission mode LM1, while "LM2" indicates the light emission mode LM2. A part B in FIG. 9 illustrates an example of the second switchable period to be provided, while a part C in FIG. 9 shows a time axis. As illustrated in FIG. 9, the second switchable period is provided at a time Tg corresponding to a time after 8 seconds from a time Tf corresponding to switching from the light emission mode LM1 to the light emission mode LM2, for example. The second switchable period continues until a timing signal is supplied from the signal processing unit 210 to the system controller 230.

Control for providing the first switchable period by the system controller 230 is referred to as control for opening a gate G1 as appropriate. On the other hand, control for providing the second switchable period by the system controller 230 is referred to as control for opening a gate G2 as appropriate.

[Example of Light Emission Mode Switching Control]

An example of light emission mode switching control is hereinafter described. A part A in FIG. 10 illustrates light emission modes. In the figure, "LM1" indicates the light emission mode LM1, while "LM2" indicates the light emission mode LM2. A part B in FIG. 10 illustrates opened state and closed state of the gate G1. A part C in FIG. 10 illustrates respective states in the light emission mode LM1. In the figure, "P" indicates the state ST2 in the light emission mode LM1, while "W" indicates the state ST1 or the state ST3 in the light emission mode LM1. A part of the states in the light emission mode LM1 is simplified in the part C in FIG. 10.

A part D in FIG. 10 illustrates timing signals input to the system controller 230. A part E in FIG. 10 illustrates opened state and closed state of the gate G2. A part F in FIG. 10 shows a time axis.

According to this embodiment, the light emission mode is switched in the following manner, for example.

1. Condition for Switching From Light Emission Mode LM1 to Light Emission Mode LM2

When a timing signal is input in the opened state of the gate G1 under the state ST1 or the state ST3, the system controller 230 instructs the LED controller 240 to switch the light emission mode LM1 to the light emission mode LM2. The LED controller 240 allows the LED 400 to emit light in a manner defined in the state ST4 of the light emission mode LM2 in response to the instruction from the system controller 230.

When the LED 400 starts blinking at a high speed during presentation of a short pattern in the state ST2 in response to switching to the light emission mode LM2, the user may recognize the change of the light emission mode as noise. Accordingly, switching of the light emission mode is not allowed in this embodiment during the state ST2 in the light emission mode LM1.

2. Condition for Switching From Light Emission Mode LM2 to Light Emission Mode LM1

When a timing signal is input in the opened state of the gate G2, the system controller 230 instructs the LED controller 240 to switch the light emission mode LM2 to the light emission mode LM1. The LED controller 240 allows the LED 400 to emit light in the light emission pattern defined in the control state of the light emission mode LM1 in response to the instruction from the system controller 230. The LED controller 240 allows the LED 400 to emit light in a manner defined in the state ST2 of the light emission mode LM1, for example, based on input of the timing signal, i.e., detection of a beat.

Specific description is now presented with reference to a timing chart in FIG. 10. The light emission mode is set to the light emission mode LM1 with a count start of the timer at a time Tj corresponding to a start of reproduction of a tune.

The gate G1 is opened at a time Tk corresponding to a time after 30 seconds from the time Tj. As described above, the gate G1 is cyclically opened. A beat is detected by the signal processing unit 210 at a predetermined time Tl during the opened state of the gate G1, whereby a timing signal is input to the system controller 230. The system controller 230 determines whether to switch the light emission mode in response to a trigger of the timing signal thus input. The system controller 230 instructs the LED controller 240 to switch the light emission mode LM1 to the light emission mode LM2 based on the current state, i.e., the state ST1 or the state ST3, in the light emission mode LM1. The LED controller 240 allows the LED 400 to emit light in the light emission pattern corresponding to the light emission mode LM2 in response to the instruction from the system controller 230.

The gate G2 is opened at a time Tm corresponding to a time after 8 seconds from the time Tl, for example. A beat is detected by the signal processing unit 210 at a predetermined time Tn during the opened state of the gate G2, whereby a timing signal is input to the system controller 230. The system controller 230 determines whether to switch the light emission mode in response to a trigger of the timing signal thus input. The system controller 230 instructs the LED controller 240 to switch the light emission mode LM2 to the light emission mode LM1 based on input of the timing signal in the opened state of the gate G2. The LED controller 240 allows the LED 400 to emit light in the light emission pattern corresponding to the light emission mode LM1 in response to the instruction from the system controller 230. Thereafter, the gate G2 is closed.

A timing signal is input to the system controller 230 in the opened state of the gate G1 at a predetermined time To after the shift of the light emission mode to the light emission mode LM1. The system controller 230 determines whether to switch the light emission mode in response to a trigger of the timing signal thus input. In this case, the system controller 230 ignores the input of the timing signal based on the current state, i.e., the state ST2 in the light emission mode LM1. In other words, the system controller 230 does not instruct the LED controller 240 to switch the current light emission mode.

A timing signal is input to the system controller 230 in the opened state of the gate G1 at a predetermined time Tp in the light emission mode LM1. The system controller 230 determines whether to switch the light emission mode in response to a trigger of the timing signal thus input. The system controller 230 instructs the LED controller 240 to switch the light emission mode LM1 to the light emission mode LM2 based on the current state, i.e., the state ST1 or the state ST3, in the light emission mode LM1. The LED controller 240 allows the LED 400 to emit light in the light emission pattern corresponding to the light emission mode LM2 in response to the instruction from the system controller 230.

The gate G2 is opened at a time Tq corresponding to a time after 8 seconds from the time Tp, for example. A beat is detected by the signal processing unit 210 at a time Tr substantially synchronous with the opening of the gate G2, whereby a timing signal is input to the system controller 230. The system controller 230 determines whether to switch the light emission mode in response to a trigger of the timing signal thus input. The system controller 230 instructs the LED controller 240 to switch the light emission mode LM2 to the light emission mode LM1 based on input of the timing signal in the opened state of the gate G2. The LED controller 240 allows the LED 400 to emit light in the light emission pattern corresponding to the light emission mode LM2 in response to the instruction from the system controller 230. Thereafter, the gate G2 is closed.

The light emission mode is switched under the control described in this example. At least one of advantageous effects described below is offered based on switching of the light emission mode performed in this embodiment.

The light atmosphere within one tune dynamically changes with emission of light from the LEDs in the light emission pattern of the light emission mode LM2, i.e., in a manner asynchronous with detection of a beat. This effect achieves attractive illumination.

The mode of light emission switchable in synchronization with detection of a beat naturally switches without giving a sudden change to the user.

Frequent changes of the light emission mode are avoidable by providing the switchable period (first switchable period and second switchable period in the example discussed above).

Control performed by the system controller becomes simple by providing the switchable period at the timing specified beforehand. Accordingly, real-time processing is realizable by eliminating the necessity of analyzing the structure of a tune beforehand by using a complicated method. Moreover, metadata describing the structure of the tune need not be obtained.

The light emission mode shifts to the light emission mode LM2 and the LEDs start blinking at a high speed when a beat is detected during light emission from the LEDs in the light emission pattern of the state ST3, for example. This blinking realizes light performance effective in giving the user a feeling of release.

The control including the switchable period does not necessarily change the light emission mode even at the time of detection of a beat. Accordingly, the user enjoys a swing (irregularity) of switching of the light emission mode.

2. Second Embodiment

A second embodiment is hereinafter described. The configuration of the audio reproduction device, control for switching the light emission mode, and other points according to the second embodiment are similar to the corresponding points of the first embodiment, and therefore are not repeatedly discussed herein. The matters described in the first embodiment are applicable to the corresponding matters of the second embodiment unless specified otherwise. According to the second embodiment, a plurality of LEDs are divided into two or more groups, for example, and allowed to emit light in the light emission mode LM2 in different light emission patterns for each group.

The plurality of LEDs 400 are divided into a first light emission element group and a second light emission element group, for example. The plurality of LEDs 400 are divided into groups in arbitrary manners. For example, the LEDs provided on the control unit 200 (such as LEDs 401, 402, 403, and up to 411) may be included in the first light emission element group, while the LEDs provided in the vicinity of the speaker unit (such as LEDs 420, 421, and 430) may be included in the second light emission element group. Alternatively, the LEDs provided on the control unit 200 and the LEDs provided in the vicinity of the speaker having the small diameter (such as LED 430) may be included in the first light emission element group, while the LEDs provided in the vicinity of the speaker unit having the large diameter (such as LEDs 420 and 421) may be included in the second light emission element group.

Respective states in each of the light emission modes are hereinafter described with reference to FIG. 11. The respective states in the light emission mode LM1 and a transition of the respective states are similar to those of the first embodiment discussed above, and therefore are not repeatedly explained herein. In the light emission mode LM2, states ST10 and ST20 are specified to perform controls corresponding to the state ST10 and the state ST20 simultaneously or substantially simultaneously.

The state ST10 is a control state for alternating the state ST1 and the state ST2 discussed above. When the light emission mode LM1 is switched to the light emission mode LM2, for example, the first light emission element group emits light in the light emission pattern corresponding to the state ST2. More specifically, a short pattern defined beforehand is reproduced by the first light emission element group in synchronization with detection of a beat (i.e., input of timing signal). After completion of presentation of the short pattern, the state ST2 shifts to the state ST1.

The state ST20 is a control state similar to the control corresponding to the state ST4 discussed above. More specifically, the second light emission element group blinks at a high speed when the light emission mode LM1 is switched to the light emission mode LM2.

According to the light control in the light emission mode LM2 of the second embodiment described above, a part of LEDs emit light in synchronization with detection of a beat, while the other LEDs blink at a high speed. This light emission control gives the user an impression of controlled light emission operation of the whole LEDs, thereby achieving well-balanced illumination.

When all the LEDs blink at a high speed at the time of switching from the light emission mode LM1 to the light emission mode LM2, some users may feel uncomfortable. However, a part of the LEDs are configured to emit light in synchronization with detection of a beat to give a sense of stability to such users while offering an atmosphere different from the atmosphere of light emission in the light emission mode LM1. The color of light emitted from the first light emission element group may be different from the color of light emitted from the second light emission element group.

3. Modified Examples

The present disclosure is not limited to the plurality of specific embodiments described above, but may be modified in various ways within the scope of the technical spirit of the present disclosure.

According to the embodiments described above, a so-called 2-way structure is adopted to include a speaker unit for reproducing a low range and a speaker unit for reproducing middle and high ranges. However, the present disclosure is applicable to a 1-way speaker. For example, the present disclosure is applicable to a structure illustrated in FIG. 12, which includes a full-range speaker unit 350*a* on the speaker SP1 side, and a full-range speaker unit 350*b* on the speaker SP2 side. In this case, the LEDs provided on the control unit 200 may be included in the first light emission element group, while the LEDs provided in the vicinity of the speaker units 350*a* and 350*b* may be included in the second light emission element group to divide the plurality of LEDs into groups.

The audio reproduction device according to the embodiments described above may be used in conjunction with an image display device such as a television set.

The present disclosure may be realized in the form of a method, a program, a system or the like, as well as a device. The program according to the present disclosure may be presented to the user via a network, or a portable memory such as an optical disk and a semiconductor memory.

The configurations and processes according to the embodiments and modified examples may be combined as appropriate within a range not producing technical inconsistencies. The order of the respective processes presented only by way of example in the flow of the processes may be changed as appropriate within a range not producing technical inconsistencies.

The present disclosure may have the following configurations.

(1)

A reproduction device including: a plurality of speakers each of which reproduces a sound corresponding to an audio signal;

a plurality of light emission elements;

a detection unit that analyzes the audio signal, and outputs a timing signal corresponding to an analysis result;

a light emission control unit that allows the light emission elements to emit light in a first light emission mode or a second light emission mode; and a switching control unit that provides a switchable period for switching one of the light emission modes to the other of the light emission modes, and determines whether to switch the current light emission mode in response to a trigger of the timing signal input in the switchable period.

(2)

The reproduction device according to (1), wherein the switching control unit cyclically provides a first switchable period for switching the first light emission mode to the second light emission mode, and provides a second switchable period for switching the second light emission mode to the first light emission mode after an elapse of a predetermined time from the switching to the second light emission mode.

(3)

The reproduction device according to (2), wherein the first light emission mode is a mode for switching at least between a first control state and a second control state, and the switching control unit switches the first light emission mode to the second light emission mode in response to input of the timing signal during the first switchable period under the first control state, and does not switch the light emission mode in response to input of the timing signal during the first switchable period under the second control state.

(4)

The reproduction device according to (2) or (3), wherein the switching control unit switches the second light emission mode to the first light emission mode in response to input of the timing signal during the second switchable period.

(5)

The reproduction device according to (3) or (4), wherein a light emission pattern asynchronous with input of the timing signal is presented in the first control state, and a light emission pattern synchronous with input of the timing signal is presented in the second control state.

(6)

The reproduction device according to any one of (1) through (5), wherein the plurality of light emission elements include a first light emission element group and a second light emission element group.

(7)

The reproduction device according to (6), wherein the detection unit, the light emission control unit, and the switching control unit are combined into a control unit, the first light emission element group is provided on the control unit, and the second light emission element group is provided in the vicinity of the speaker.

(8)

The reproduction device according to (6), wherein the speaker includes a first speaker unit having a first diameter, and a second speaker unit having a second diameter larger than the first diameter, the first light emission element group is provided in the vicinity of the first speaker unit, and the second light emission element group is provided in the vicinity of the second speaker unit.

(9)

The reproduction device according to any one of (6) through (8), wherein the light emission control unit allows the first light emission element group to emit light in a pattern synchronous with input of the timing signal, and allows the second light emission element group to emit light in a pattern asynchronous with input of the timing signal at the time of switching from the first light emission mode to the second light emission mode.

(10)

The reproduction device according to any one of (1) through (9), wherein the detection unit detects a beat of the audio signal, and outputs a timing signal corresponding to the beat.

(11)

The reproduction device according to any one of (1) through (10), wherein the light emission elements are LEDs.

(12)

A reproduction method of a reproduction device, wherein a detection unit analyzes an audio signal supplied to a speaker and outputs a timing signal corresponding to an analysis result, a light emission control unit allows light emission elements to emit light in a first light emission mode or a second light emission mode, and a switching control unit provides a switchable period for switching one of the light emission modes to the other of the light emission modes, and determines whether to switch the current light emission mode in response to a trigger of the timing signal input in the switchable period.

REFERENCE SIGNS LIST

10 Reproduction device
200 Control unit
210 Signal processing unit
230 System controller
240 LED controller
300, 301 Speaker
400 LED

The invention claimed is:

1. A reproduction device, including:

a speaker configured to reproduce a sound corresponding to an audio signal;

at least a light emission element;

a detection unit configured to analyze the audio signal, and output a timing signal corresponding to an analysis result;

a light emission control unit configured to allow the light emission element to emit light in a first light emission mode or a second light emission mode; and a switching control unit configured to provide a switchable period for switching one of the light emission modes to the other of the light emission modes, and determine whether to switch the current light emission mode in response to a trigger of the timing signal input in the switchable period.

2. The reproduction device according to claim 1, wherein the switching control unit is further configured to cyclically provide a first switchable period for switching the first light emission mode to the second light emission mode, and provide a second switchable period for switching the second light emission mode to the first light emission mode after an elapse of a predetermined time from the switching to the second light emission mode.

3. The reproduction device according to claim 2, wherein the first light emission mode is a mode for switching at least between a first control state and a second control state, and the switching control unit is further configured to switch the first light emission mode to the second light emission mode in response to input of the timing signal during the first switchable period under the first control state, and does not switch the light emission mode in response to input of the timing signal during the first switchable period under the second control state.

4. The reproduction device according to claim 2, wherein the switching control unit is further configured to switch the second light emission mode to the first light emission mode in response to input of the timing signal during the second switchable period.

5. The reproduction device according to claim 3, wherein a light emission pattern asynchronous with input of the timing signal is presented in the first control state, and a light emission pattern synchronous with input of the timing signal is presented in the second control state.

6. The reproduction device according to claim 1, wherein the plurality of light emission elements include a first light emission element group and a second light emission element group.

7. The reproduction device according to claim 6, wherein the detection unit, the light emission control unit, and the switching control unit are combined into a control unit, the first light emission element group is provided on the control unit, and the second light emission element group is provided in the vicinity of the speaker.

8. The reproduction device according to claim 6, wherein the light emission control unit is further configured to allow the first light emission element group to emit light in a pattern synchronous with input of the timing signal, and allow the second light emission element group to emit light in a pattern asynchronous with input of the timing signal at the time of switching from the first light emission mode to the second light emission mode.

9. The reproduction device according to claim 1, wherein the detection unit is further configured to detect a beat of the audio signal, and outputs a timing signal corresponding to the beat.

10. The reproduction device according to claim 1, wherein the at least a light emission element is LED.

11. A reproduction method of a reproduction device, wherein a detection unit analyzes an audio signal supplied to a speaker and outputs a timing signal corresponding to an analysis result, a light emission control unit allows light emission element to emit light in a first light emission mode or a second light emission mode, and a switching control unit provides a switchable period for switching one of the light emission modes to the other of the light emission modes, and determines whether to switch the current light emission mode in response to a trigger of the timing signal input in the switchable period.

* * * * *